US006518528B2

(12) United States Patent
Nickerson et al.

(10) Patent No.: US 6,518,528 B2
(45) Date of Patent: Feb. 11, 2003

(54) LIMIT SWITCH WITH DIRECT OPENING ACTION

(75) Inventors: Robert W. Nickerson, Chelmsford, MA (US); James C. Taylor, Lynn, MA (US); Gregory W. Swider, Woburn, MA (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 0 days.

(21) Appl. No.: 09/832,785

(22) Filed: Apr. 11, 2001

(65) Prior Publication Data

US 2002/0148713 A1 Oct. 17, 2002

(51) Int. Cl.[7] ..... H01H 5/30

(52) U.S. Cl. ..... 200/447; 200/16 A; 200/273; 200/47

(58) Field of Search ..... 200/16 A, 243, 200/402–472, 47

(56) References Cited

U.S. PATENT DOCUMENTS

| | | | | |
|---|---|---|---|---|
| 3,769,474 A | | 10/1973 | Duebel et al. | |
| 3,919,506 A | * | 11/1975 | Kellogg | 200/16 A |
| 4,347,415 A | | 8/1982 | Falchi | |
| 4,477,703 A | * | 10/1984 | Soler | 200/76 |
| 4,634,820 A | | 1/1987 | Noguchi | |
| 4,716,263 A | * | 12/1987 | Havel | 200/11 R |
| 4,978,824 A | | 12/1990 | Allen | |
| 4,982,106 A | * | 1/1991 | Castellanet et al. | 307/120 |
| 5,532,444 A | | 7/1996 | Bonrath et al. | |
| 5,790,010 A | | 8/1998 | Schwab | |
| 6,198,058 B1 | * | 3/2001 | Graninger et al. | 200/50.02 |

OTHER PUBLICATIONS

Allen–Bradley Catalog entitled "Sensors"; (Chapter 6 only entitled "Limit Switches") (printed from CD Rom); 96–pg. document; Oct. 1999.

* cited by examiner

*Primary Examiner*—Elvin Enad
*Assistant Examiner*—Kyung S. Lee
(74) *Attorney, Agent, or Firm*—Tait R. Swanson; Alexander M. Gerasimow; William R. Walbrun

(57) ABSTRACT

A switch comprises a first and second contacts, a plunger, a toggle bar, and a spanner. A preferred trip lever arrangement is used in which a trip lever transfers an actuating force from the plunger to the toggle bar, and the toggle bar is caused to move farther than the plunger to provide a short trip point. Swing arms that are acted upon through a series of rigid body force transfers allow an operator to manually force welded contacts to be broken in the event that the contacts become welded to a spanner or other components of the switch assembly.

25 Claims, 5 Drawing Sheets

LIMIT SWITCH WITH DIRECT OPENING ACTION

FIELD OF THE INVENTION

The present invention relates to switches for electrical circuits. In a particularly preferred embodiment, the present invention relates to switches that are used in industrial applications, such as limit switches.

BACKGROUND OF THE INVENTION

Switches are commonly employed as input devices to indicate the presence or absence of a particular condition in a system or process that is being monitored and/or controlled. Switches have found particular use in industrial control systems, where it is often desirable to monitor conditions so that appropriate actions may be taken in response to the monitored conditions. For example, limit switches are typically utilized in industrial control applications to automatically monitor and indicate whether the travel limits of a particular device have been exceeded.

Certain characteristics have been found to be desirable in switches. First, it is desirable in many applications to provide a switch with a short trip point. The trip point refers to the amount of movement that must be incurred by an actuation mechanism of the switch before the switch trips. A short trip point is desirable, because a short trip point implies that the actuation mechanism must only travel a short distance and therefore that the limit switch responds more quickly to an external event.

Second, it is desirable in many applications to provide a switch that changes between an unactuated state and an actuated state in as little time as possible. This allows the switch to change states and provide a stable output respond more quickly after the occurrence of the external event.

Third, it is desirable in many applications to provide a switch that is capable of being manually forced to break a weld in the event that the contacts become welded to a spanner or other components of the switch assembly. In some switch applications, the contacts and the spanner of the switch may unintentionally and undesirably become welded together, for example, due to a transient voltage or current in-rush condition. In these situations, it is desirable to make it possible to forcibly break the weld if enough force and displacement are applied to an actuator mechanism of the switch. It is further desirable, for sake of ruggedness and durability, to provide a mechanism that is capable of breaking a weld using a mechanism that consists of only of rigid body components. Indeed, ruggedness and durability are themselves additional desirable characteristics of switches.

While switches that to some extent have one or more of these characteristics have previously been provided, further improvements are still needed. A switch and a method of operating a switch that offers an improvement over existing designs in one or more of the above-mentioned aspects would be highly desirable.

SUMMARY OF THE INVENTION

According to a first preferred embodiment of the invention, a switch comprises first and second contacts, a plunger, a toggle bar, a spanner and a trip lever. The plunger is capable of receiving an actuating force and is moveable in response to said actuating force. The toggle bar is also moveable and has first and second positions. The spanner has first and second positions that respectively correspond to the first and second positions of the toggle bar. The spanner establishes an electrical connection between the first and second contacts when the spanner is in one of the first and second positions, and does not establish the electrical connection between the first and second contacts when the spanner is in the other of the first and second positions. The trip lever is operatively disposed between the plunger and the toggle bar. The trip lever is capable of receiving the actuating force from the travel plunger at an input location on the trip lever and transferring the actuating force to the toggle bar at an output location on the trip lever, causing the toggle bar to move from the first position to the second position of the toggle bar. The output location of the trip lever travels a greater distance than the input location when the actuating force is transferred to the toggle bar.

According to a second preferred embodiment of the invention, a switch comprises a pretravel plunger, first and second levers, an over-travel plunger, first and second contacts, and a spanner. The pretravel plunger is moveable in a longitudinal direction in response to an actuating force, and includes a post that is moveable with the pretravel plunger in the longitudinal direction. The first and second levers are hingedly mounted and are moveable in response to movement of the post to permit an aperture to form between the first and second levers that is sufficient in size to permit the post to pass between the first and second levers. The over-travel plunger is moveable along the longitudinal axis in response to movement of the first and second levers. The over-travel plunger has a cavity formed therein at a longitudinal end adjacent the post. The cavity is capable of receiving the post after the post passes between the first and second levers. The spanner is moveable between first and second positions in response to movement of the over-travel plunger. The spanner establishes an electrical connection between the first and second contacts when the spanner is in one of the first and second positions, and does not establish the electrical connection between the first and second contacts when the spanner is in the other of the first and second positions.

Other objects, features, and advantages of the present invention will become apparent to those skilled in the art from the following detailed description and accompanying drawings. It should be understood, however, that the detailed description and specific examples, while indicating preferred embodiments of the present invention, are given by way of illustration and not limitation. Many modifications and changes within the scope of the present invention may be made without departing from the spirit thereof, and the invention includes all such modifications.

DETAILED DESCRIPTION OF THE INVENTION

Figure 1:
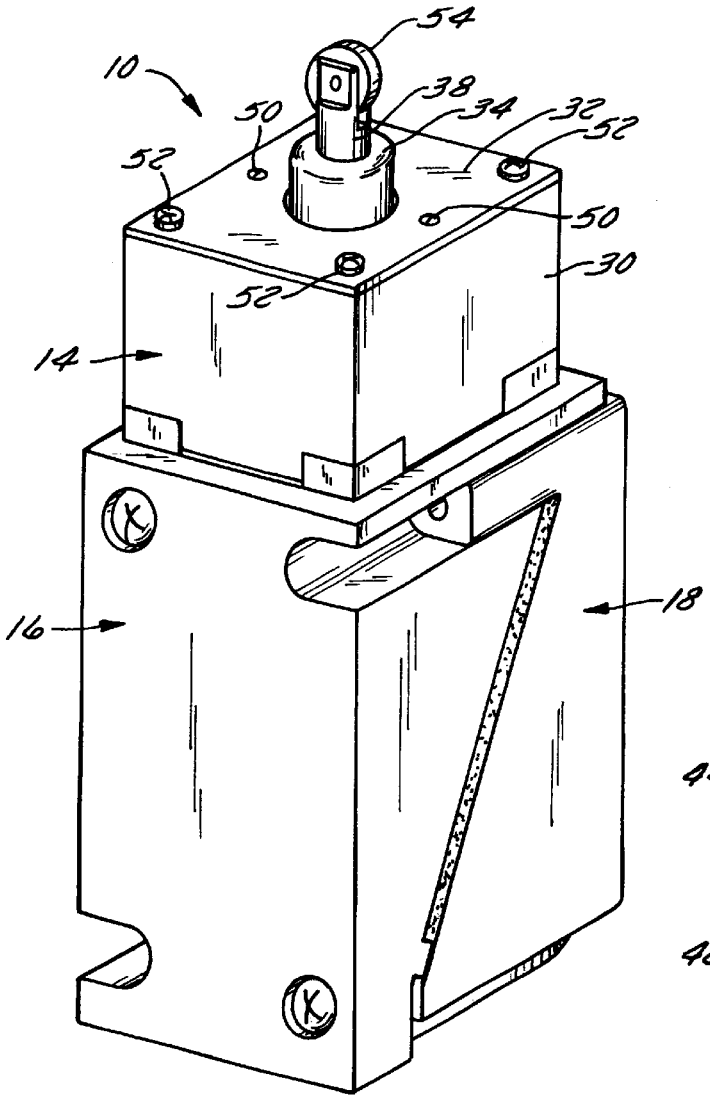
FIG. 1 is a perspective view of a limit switch with direct opening action.

Referring now to FIG. 1, a perspective view of a limit switch 10 with direct opening action is shown. By way of overview, the limit switch 10 comprises an operator head assembly 14, a switch base assembly 16, and a terminal base assembly 18. The operator head assembly 14 is configured to receive an actuating force and to transfer the actuating force to the switch base assembly 16. The switch base assembly 16 switches between actuated/unactuated positions depending on whether an actuating force is received by the operator head assembly 14. The terminal base assembly 18 comprises operator wiring terminals for wiring to the limit switch 10. An electrical connection is established or not established between the operator wiring terminals depending on the actuated/unactuated state of the limit switch 10.

Figure 2:
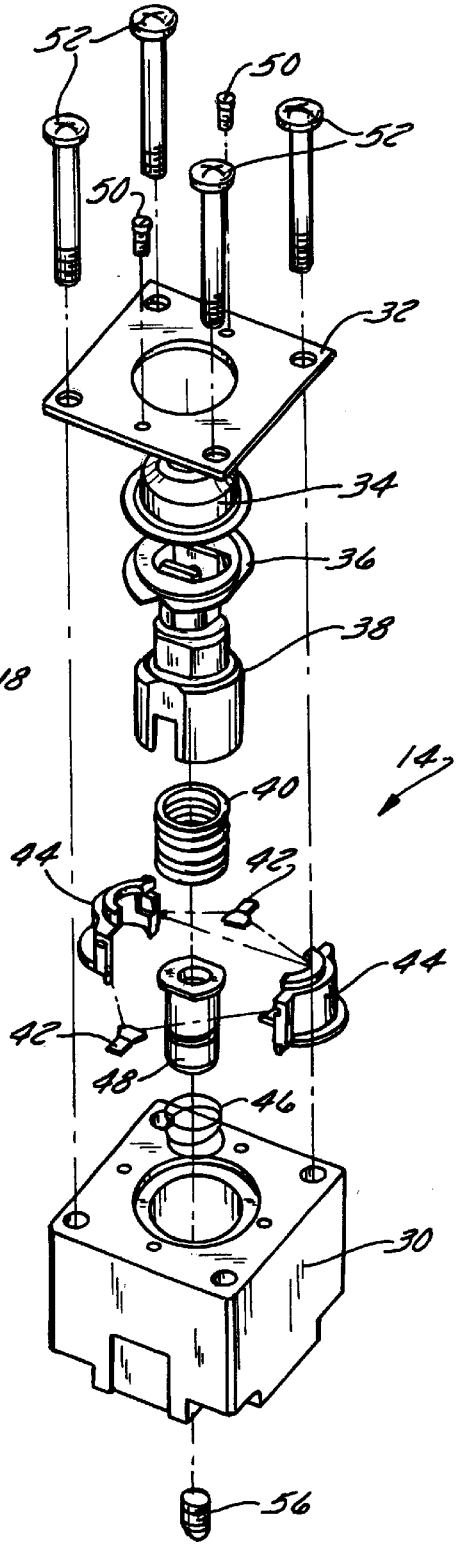
FIG. 2 is an exploded view of an operator head assembly of the limit switch of FIG. 1.
Figure 3B:
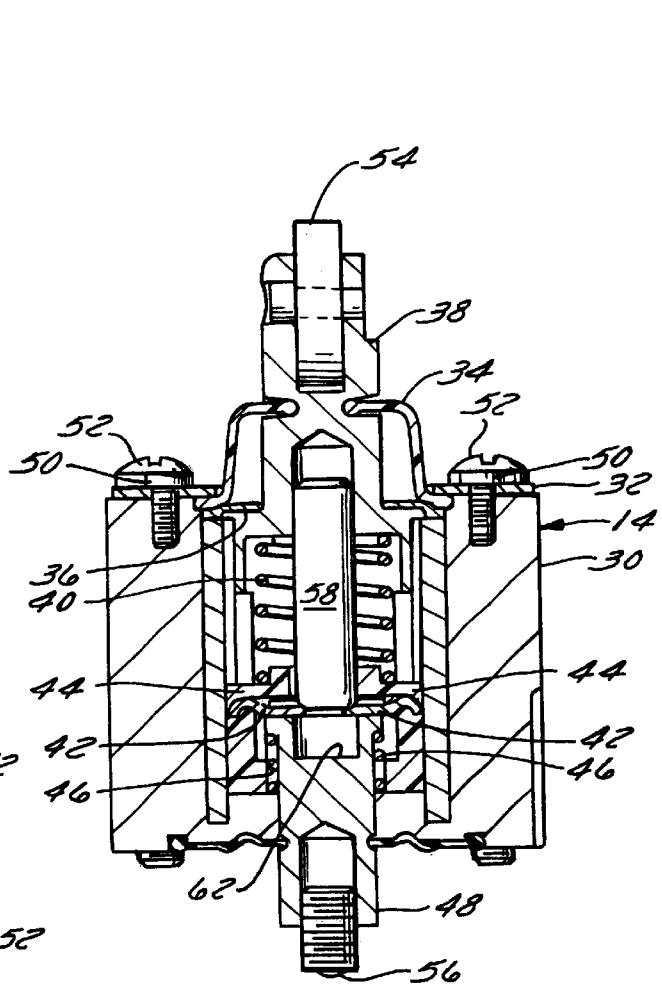
FIGS. 3A and 3B are cross-sectional views of the operator head assembly.
Figure 3A:
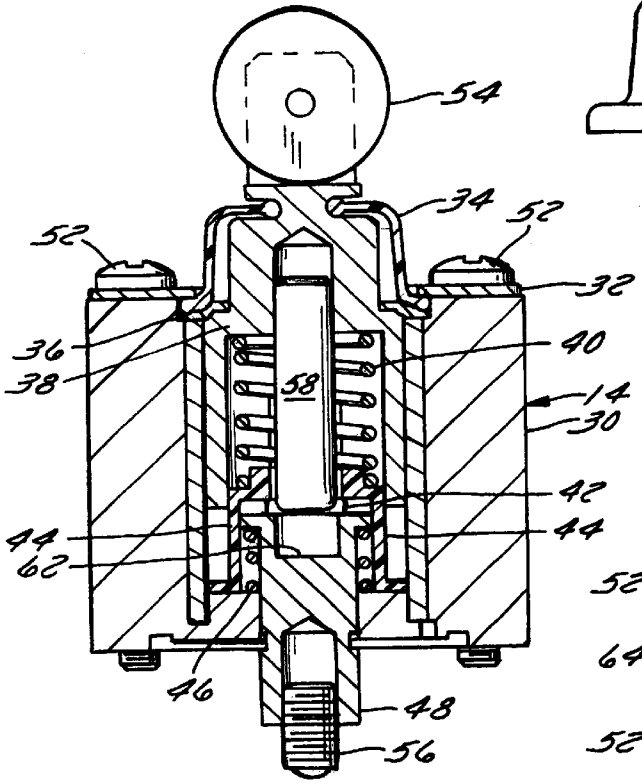

Referring now also to FIGS. 2, 3A, and 3B, the operator head assembly 14 of FIG. 1 is shown in greater detail. FIG. 2 is an exploded view of the operator head assembly 14. FIGS. 3A and 3B are side cross sectional views of the operator head assembly 14.

Figure 4:
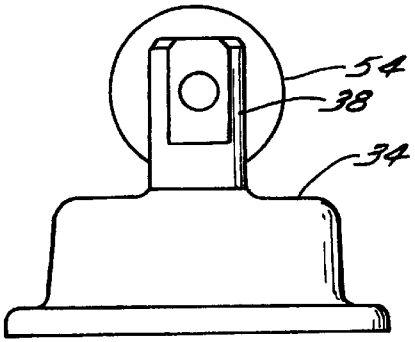
FIG. 4 is a side view of a roller assembly for the operator head assembly.

The operator head assembly 14 comprises an operator head housing 30 and a retainer plate 32. The operator head assembly 14 further comprises, from top to bottom in FIG. 2, a gasket 34, an anti-rotation plate 36, a pretravel plunger 38, a spring 40, levers 42, retainers 44, a spring 46, and an over-travel plunger 48, all of which are mounted within the housing 30 and retained by the retainer plate 32. The retainer plate 32 is fastened to the operator head housing 30 by bolts 50, and the operator head assembly 14 is fastened to the remainder of the limit switch 10 by bolts 52. Finally, the operator head assembly 14 comprises a roller assembly 54 (also shown in FIG. 4) and a calibration screw 56.

The operation of the operator head assembly 14 to transfer an actuating force to the switch base assembly 16 will now be described. When the limit switch 10 is actuated, the actuating force is received by the roller assembly 54 of the operator head assembly 14. The roller assembly 54 transfers the actuating force to the pretravel plunger 38. The pretravel plunger 38 is moveable in a longitudinal direction in response to the actuating force. (Herein, the direction of force transfer is referred to as the longitudinal direction.) In FIGS. 3A and 3B, the pretravel plunger 38 moves downwardly in response to the actuating force. Movement of the pretravel plunger 38 is guided by the retainers 44 as well as by the anti-rotation plate 36, which prevents rotational movement of the pretravel plunger 38.

The pretravel plunger 38 includes a post 58 which is moveable in the longitudinal direction within the pretravel plunger 38. As the pretravel plunger 38 moves downwardly in response to the actuating force, the post 58 moves with the pretravel plunger 38 and is pushed downwardly against the levers 42.

The levers 42 are rotatably (e.g., hingedly) mounted within the operator head assembly by the retainers 44, and are moveable in response to movement of the post 58. The force applied by the post 58 to the levers 42 pushes the levers 42 downwardly. Initially, the actuating force received by the levers 42 is transferred to the over-travel plunger 48, as well as to the springs 40 and 46 which provide a counter force. The over-travel plunger 48 is moveable in the longitudinal direction in response to the actuating force transferred by the levers 42. Therefore, the over-travel plunger 48 moves downwardly and transfers the actuating force to the switch base assembly 16 via the calibration screw 56. In this way, the operator head assembly 14 transfers the actuating force from the roller assembly 54 to the switch base assembly 16.

As the levers 42 continue to hinge downwardly, an aperture forms between the levers 42 that is sufficient in size to permit the post 58 to pass between the levers 42. This is shown most clearly in FIG. 6. After the post 58 passes between the levers 42, the post 58 is received by a cavity 62 formed in the over-travel plunger 48 at the longitudinal end of the over-travel plunger 48 adjacent the post 58. Therefore, once the levers 42 have pushed the over-travel plunger 48 a predetermined distance, the space between the levers 42 opens up such that the post 58 no longer pushes the levers 42 but rather travels into the cavity 62 formed within the over-travel plunger 48. The levers 42 therefore operate as a "trap-door" mechanism, allowing the post 58 to travel into the cavity 62 once the space between the levers 42 becomes sufficiently large.

After the post 58 enters the cavity 62, further travel of the pretravel plunger 38 has no effect, and further movement of the over-travel plunger 48 ceases. This allows the pretravel plunger 38 and the over-travel plunger 48 to cooperate such that the initial actuating force causes the limit switch 10 to trip, but further movement of the pretravel plunger 38 does not damage the limit switch 10. Advantageously, by providing the over-travel plunger 48 with a sufficiently deep cavity 62, the limit switch 10 can be provided with a long over-travel stroke. In the preferred embodiment, the limit switch 10 has an over-travel stroke of 4.6 millimeters and a maximum travel distance of 6.0 millimeters.

The spring 40 provides a counter force to return the pretravel plunger 38 to its original position after the actuating force is removed. Likewise, the spring 46 provides a counter force to return the over-travel plunger 48 to its original position after the actuating force is removed. The calibration screw, in addition to serving as an output of the operator head assembly 14, also provides a mechanism for calibrating the limit switch 10. That is, the trip point of the limit switch 10 can be factory adjusted by adjusting the position of the calibration screw 56.

Figure 5:
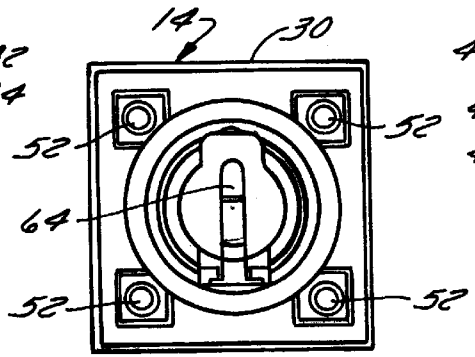
FIG. 5 is a trip lever located at a mechanical interface between the operator head assembly of FIG. 1 and a switch base assembly of the limit switch of FIG. 1.
Figure 6:
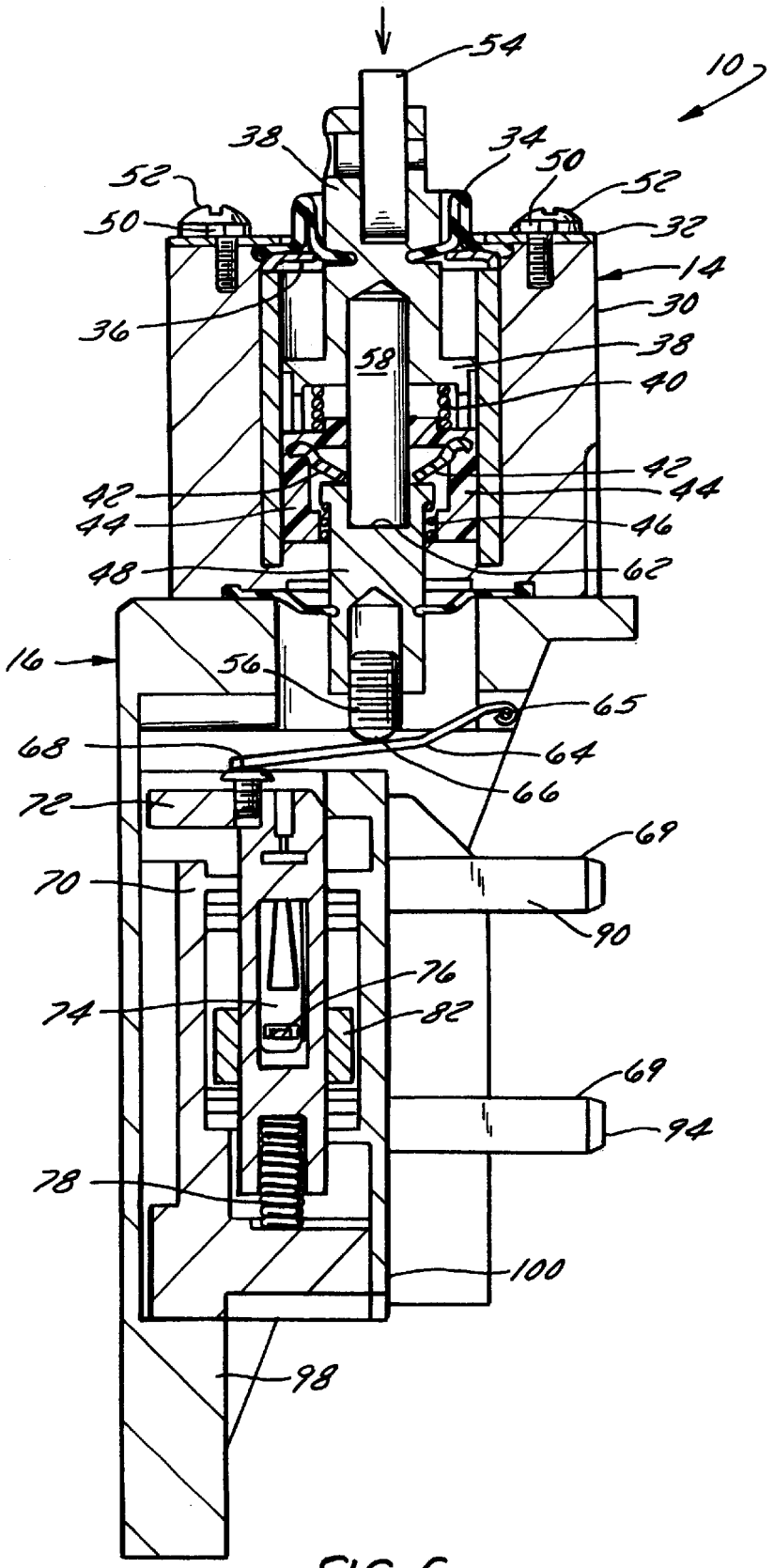
FIG. 6 is a cross-sectional view of the operator head assembly mounted on the switch base assembly.

Referring now mainly to FIGS. 5–6, FIGS. 5–6 show the manner in which the actuating force is transferred from the operator head assembly 14 to a switch block 70 of the switch base assembly 16. The actuating force is transferred by way of a trip lever 64. The trip lever 64 is operatively disposed at an interface between the operator head assembly 14 and the switch base assembly 16. The trip lever 64 is hingedly mounted and moves about a fulcrum 65. The trip lever 64 receives the actuating force from the over-travel plunger 48 (via the calibration screw 56) at an input location 66, and transfers the actuating force to a toggle bar 72 of the switch block 70 at an output location 68. The distance from the fulcrum 65 to the output location 68 is about twice the distance from the fulcrum 65 to the input location 66. Therefore, when the actuating force is transferred to the toggle bar 72, the output location 68 of the trip lever 64 travels about twice the distance traveled by the input location 66. More significantly, the toggle bar 72 travels about twice the distance traveled by the over-travel plunger 48. This allows the trip point of the limit switch 10 to maintain a short linear or rotational displacement consistent with traditional NEMA class limit switches. For example, for a top push or side push operator head, this allows a linear travel distance in the range of about 0.03 to 0.08 inches to trip the limit switch. For a rotary operator head, this allows a rotary displacement of less than 13° (preferably in the range of about 6°–11°) to trip the limit switch.

Also shown in FIG. 6 are stationary contact blades 69. The blades 69 establish an electrical connection between the switch base assembly 16 and the terminal base assembly 18. It may be noted that the limit switch 10 is a two-circuit limit switch, and each of the blades 69 establishes one connection for a respective one of the two circuits. Thus, the limit switch 10 is consistent with the "form factor" set forth by the schematic symbol Zb defined by IEC (International Electrotechnical Commission) standard 60617, namely, the limit switch 10 has four stationary contacts and two electrically separated spanners. Not shown is the other connection for each circuit, which is a second pair of blades that is provided and that is disposed behind the pair of blades shown in FIG. 6. It may also be noted that, while the switch 10 described herein is a two-circuit switch, the switch 10 could easily be provided with additional structure for additional circuits (e.g., a four-circuit switch) or could be simplified so as to form a one-circuit switch.

Figure 7:
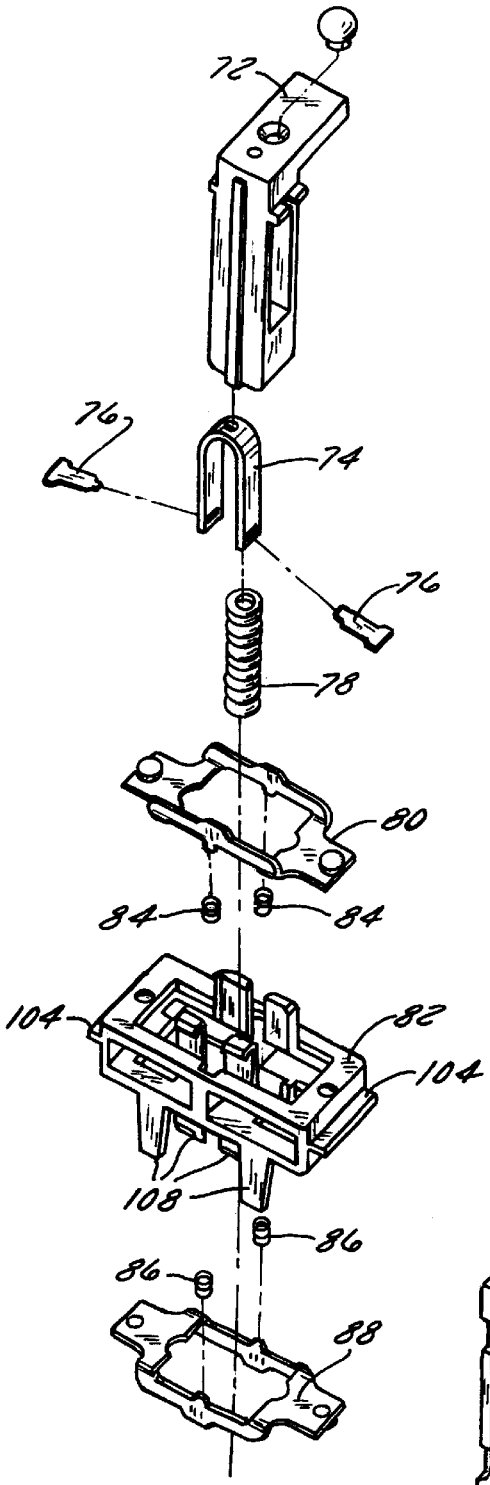
FIG. 7 is an exploded view of a portion of the switch base assembly of FIG. 1.

Referring now to FIGS. 7–12, the switch base assembly 16 is shown in greater detail. FIG. 7 is an exploded view of moveable components of the switch block 70 of the switch base assembly 16. As shown in FIG. 7, the moveable components of the switch block 70 include (from top to bottom) the toggle bar 72, a U-shaped toggle spring 74, first and second overcenter pivots 76, a toggle bar return spring 78, an upper spanner 80, a carrier 82, upper biasing springs 84, lower biasing springs 86, and a lower spanner 88.

Figure 8:
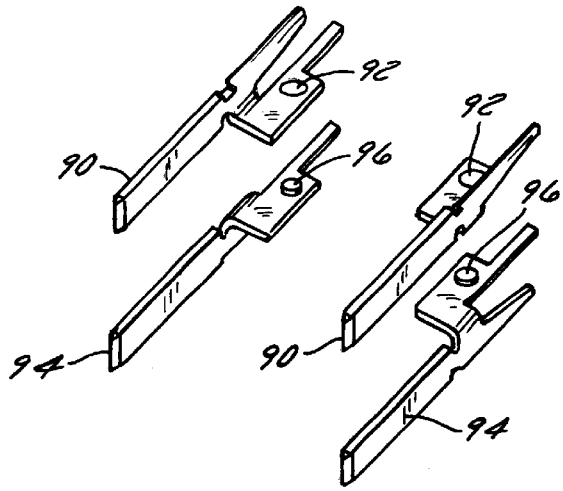
FIG. 8 is a perspective view of upper and lower contact bars of the switch base assembly.

FIG. 8 is a perspective view of upper and lower stationary contact bars 90 and 92, respectively, of the switch block 70 of FIG. 7. The upper contact bars 90 include upper stationary contacts 94, and the lower contact bars 92 include lower stationary contacts 96. The contact bars 90 and 94 and thereby the stationary contacts 92 and 96 are fixedly mounted within the switch block 70.

Figure 9:
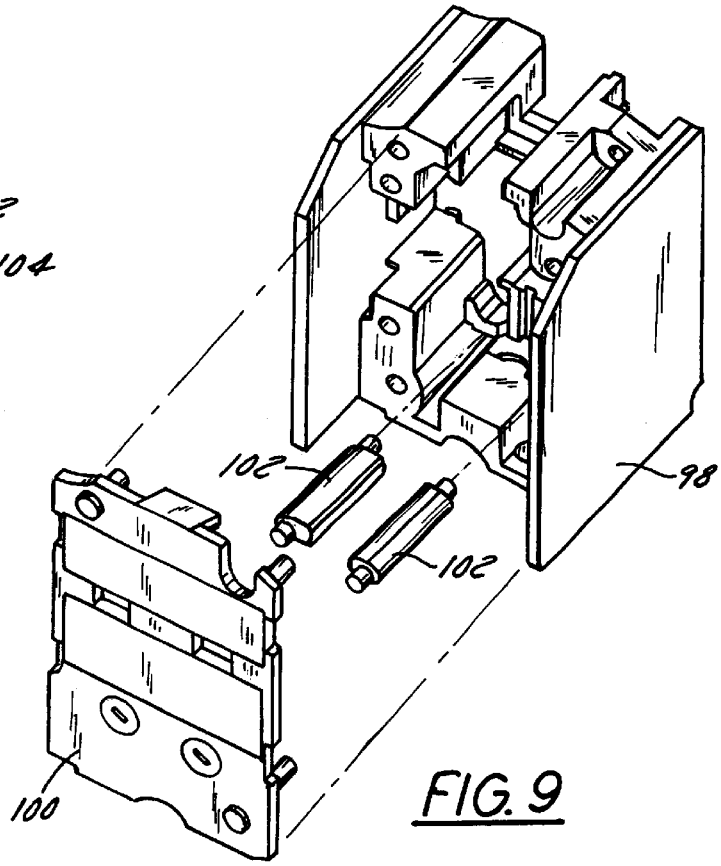
FIG. 9 is a perspective view of a housing of the switch base assembly.

FIG. 9 is a perspective view of a housing 98 and a housing cover 100 of the switch block 70. In assembled form, the moveable components shown in FIG. 7 and the stationary contact bars 90 and 94 of FIG. 8 are mounted within the housing 98 of FIG. 9. Also mounted within the housing 98 and the housing cover 100 are a pair of swing arms 102. The operation of the swing arms 102 is discussed in greater detail below.

Figure 11:
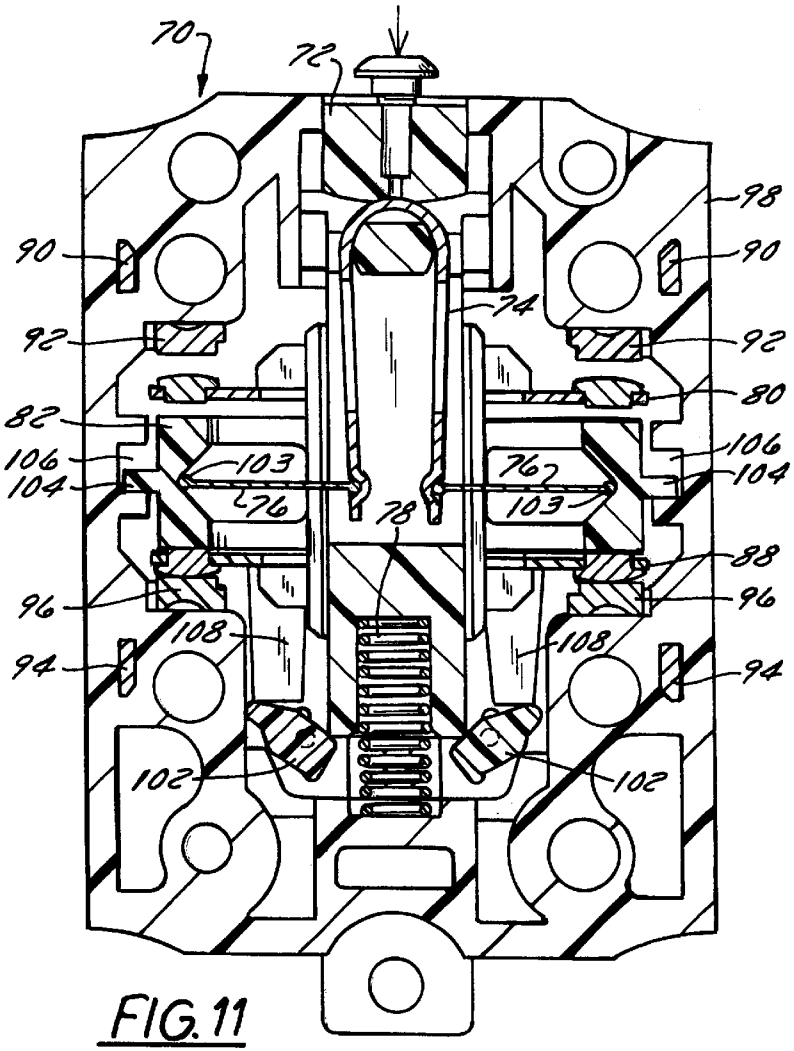
FIGS. 10–11 are a cross-sectional views of the switch base assembly.
Figure 10:
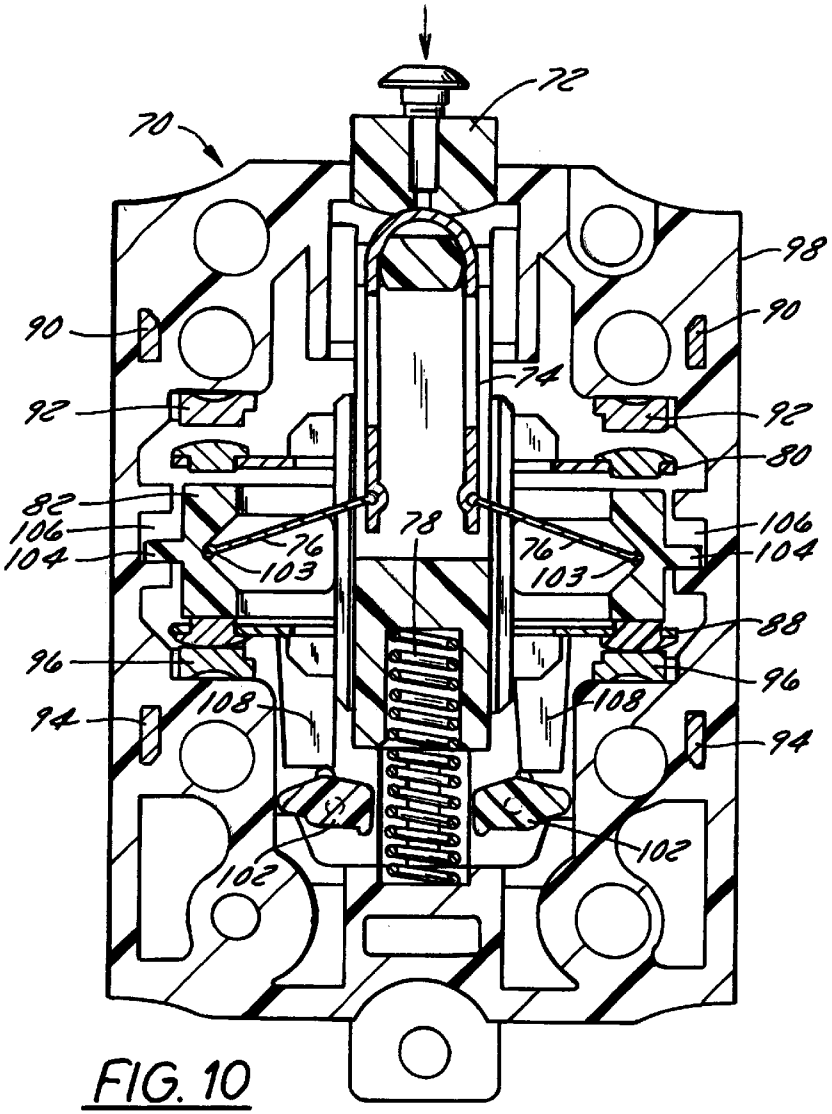

Finally, FIGS. 10–11 are cross-sectional views of the switch block 70. FIG. 10 shows the switch block 70 at rest in a first position prior to actuation and FIG. 11 shows the switch block 70 in an overcenter position immediately prior to changing states from the first (unactuated) position to a second (actuated) position.

The structure and operation of the switch block 70 will now be described in greater detail. The switch block 70 is operative to cause the spanner 80 to selectively establish an electrical connection between the contacts 92 of the upper contact bars 90 and to cause the spanner 88 to selectively establish an electrical connection between the contacts 96 of the lower contact bars 94. The contacts 92 and 96 are electrically connected to the operator wiring terminals (not illustrated) on the terminal assembly 18 by way of the blades 69. To allow the limit switch 10 to control two independent circuits, the spanners 80 and 88 are electrically separated from each other, as are the contacts 92 and 96. For durability, the contacts 92 and 96 are preferably in the range of about 0.10 to 0.15 inches in diameter.

The upper contacts 92 are normally open contacts and the lower contacts 96 are normally closed contacts. In other words, when the limit switch 10 is in a first (unactuated) position, an electrical connection is established between the lower contacts 96 by the lower spanner 88, and no electrical connection is established between the upper contacts 92 by the upper spanner 80. On the other hand, when the limit switch 10 is in a second (actuated) position, no electrical connection is established between the lower contacts 96 by the lower spanner 88, but an electrical connection is established between the upper contacts 92 by the upper spanner 80.

The spanners 80 and 88 are moveable and have first and second positions that correspond to first and second positions of the toggle bar 72. To this end, the spanners 80 and 88 are mounted to the carrier 82 by way of the biasing springs 84 and 86. The carrier 82 is slidably mounted to the toggle bar 72. In particular, the carrier 82 is capable of sliding along the toggle bar 72, including sliding in the opposite direction that the toggle bar 72 is moving. The toggle bar 72 extends through from the top of the switch block 70 to a location adjacent the swing arms 102. The toggle bar 72 is moveable in the longitudinal direction (again, the direction of force transfer, downward in FIG. 10), and has first and second positions that respectively correspond to the first and second (unactuated and actuated) positions of the limit switch 10.

Movement of the carrier 82 relative to the toggle bar 72 is controlled by the overcenter pivots 76 and the U-shaped toggle spring 74. The pivots 76 have first and second positions that respectively correspond to the first and second positions of the limit switch 10. The pivots 76 are each mechanically coupled between the U-shaped spring 74 and the carrier 82. The U-shaped spring 74 is mounted within the toggle bar 72 and includes notches that receive ends of the pivots 76. The U-shaped spring 74 causes the pivots 76 to be retained within V notches 103 of the carrier 82.

Movement of the carrier 82 depends on the relative position of the toggle bar 72 and the pivots 76. The U-shaped spring 74 applies a force through the pivots 76 so as to cause the upper spanner 80 and the lower spanner 88 to move between the first and second positions in snap action fashion. The orientation of the pivots 76 in FIG. 10 urges the carrier 82 to remain static on the closed lower contacts 96. The orientation of the pivots 76 in FIG. 11 results in an overcenter position for the pivots 76 and the carrier 82 in which the carrier 82 is not urged either upwardly or downwardly. When the toggle bar 72 moves down slightly from the position shown in FIG. 11, the carrier 82 is urged upwardly.

As just noted, the overcenter position illustrated in FIG. 11, in which the pivots 76 are perpendicularly oriented relative to the direction of travel of the toggle bar 72, results in a dead spot in which the carrier 82 is not urged upwardly or downwardly. The biasing springs 84 and 86 are provided to reduce transit time of the carrier 82 through the dead spot. As previously noted, the spanners 80 and 88 are mounted to the carrier by way of the biasing springs 84 and 86. The biasing springs 84 and 86 provide a biasing force to carry the carrier 82 through the overcenter position when the carrier 82 is moving between the actuated and unactuated positions and thereby reduce snap-over time. The biasing springs 84 and 86 also help align the various moveable components in the switch block 70 and help compensate for any uneven forces or misaligned components. The biasing springs 84 and 86 also cushion shock to the spanners 80 and 88.

Preferably, the transit time between the actuated and unactuated positions is thirty milliseconds or less during a predetermined input actuation rate of 0.5 inches per minute. In order to achieve this transit time, the carrier 82 is provided with a boss 104 on each side to limit travel distance of the carrier 82. The bosses 104 move inside a slot 106 in the switch block 70 to limit travel distance.

As previously noted, the switch block 70 also includes the swing arms 102. The purpose of the swing arms 102 is to forcibly break a weld between the lower spanner 88 and the lower contacts 96 in the event that the lower spanner 88 becomes welded to the lower contacts 96. As previously described, movement of the carrier 82 up and down is normally controlled by the pivots 76 in cooperation with the U-shaped spring 74. In the case of a weld, however, the carrier 82 cannot move up and down freely by itself. The pivots 76 and the U-shaped spring 74 do not provide enough force to break the weld.

To break a weld, a sufficient amount of force is applied such that the toggle bar 72 is pushed past the second (actuated) position of the toggle 72 and is urged toward a third position of the toggle bar 72. When the actuating force urges the toggle bar 72 toward the third position of the toggle bar 72, the actuating force is transferred from the toggle bar 72 to the swing arms 102. The swing arms 102 are rotatably mounted within the switch block 70, and are moveable between first and second positions. The swing arms 102 include lobes that apply an upward force to the legs 108 of the carrier 82 to break the contacts. Therefore, the swing arms 102 transfer the actuating force to the legs 108 of the carrier 82, and this force transfer is capable of breaking the weld between the contacts 96 and the lower spanner 88. The swing arms 82 act as a cam to push against the four legs 108 of the carrier 82 forcing the weld to break.

Notably, a weld-breaking actuation force received at the roller assembly 54 is transferred to the carrier 82 by way of the pretravel plunger 38, the levers 42, the over-travel plunger 48, the toggle bar 72, and the swing arms 102, all of which are rigid bodies. Therefore, it is possible to forcibly break a weld between the lower spanner 88 and the lower contacts 96 using a force that is applied to the carrier 82 exclusively through a series of rigid body force transfers, that is, force transfers that occur through bodies that maintain substantially the same shape during the force transfer.

The operation of the preferred switch block 70 will now be summarized with respect to FIGS. 10–11. In FIG. 10, the toggle bar 72, the pivots 74, the carrier 82, and the spanners 80 and 88 are in their respective unactuated positions. When the limit switch 10 is actuated, the operator head assembly 14 transfers the actuating force to the switch base assembly 16 via the trip lever 64, as previously described. The actuating force is received by the toggle bar 72, causing the toggle bar 72 to move downwardly from the unactuated position of FIG. 10 to the overcenter position of FIG. 11. Further movement of the toggle bar 72 causes the toggle bar 72 to surpass the overcenter position, and causes the pivots 76 to apply an upward force to the carrier 82. Eventually, the toggle bar 72, the pivots 74, the carrier 82, and the spanners 80 and 88 reach their respective actuated positions. The carrier 82 moves from the unactuated position (in which the lower spanner 88 establishes an electrical contact between the lower contacts 96) contacts to the actuated position (in which the upper spanner 80 establishes an electrical contact between the upper contacts 92) in snap action fashion. As previously noted, movement of the carrier 82 in either direction is limited by the bosses 104 which are located on either side of the carrier 82 and which move within slots 106 in the switch block housing 98. Further movement of the toggle bar 72 causes the swing arms 102 to rotate to a position in which the swing arms 102 apply an upward force against the legs 106 of the carrier 82. When the actuating force is removed, the toggle bar 72 is returned to the unactuated position by the toggle bar spring 78.

In the preferred embodiment, for durability, the limit switch 10 is constructed of metal such as zinc and aluminum casting alloys and a high temperature plastic such as PPS (polyphenylsulfide). Preferably, the plastic has a relative thermal index of approximately 130° C., thereby allowing the limit switch 10 to have a normal operating temperature in the range of about −18° C. to +110° C. The components that are constructed of metal include the housings for the operator head assembly 14, the pretravel plunger 38, the over-travel plunger 48, the switch base assembly 16, and the terminal base assembly 18. The components that are constructed of plastic include the retainers 44 and the carrier 82.

The limit switch 10 is preferably compliant with standards governing industrial switches, including National Electrical Manufacturers Association (NEMA) and International Electrotechnical Commission (IEC) standards. The illustrated limit switch 10 has a maximum force to operate of 13.8 Newtons, a maximum travel to operate contacts distance of 1.4 millimeters, an over-travel stroke of 4.6 millimeters, a maximum travel distance of 6.0 millimeters, and a maximum travel to reset contacts distance of 0.7 millimeters. These parameters are exemplary for the illustrated embodiment, and may be different especially if a different type of operator head is used. In this regard, it may be noted that although the operator head assembly 14 is a top push operator head, other operator heads could be implemented, such as lever, maintained, low operating force, side push (with or without rollers), cat whisker, wobble stick and neutral position operator heads.

Many other changes and modifications may be made to the present invention without departing from the spirit thereof. The scope of these and other changes will become apparent from the appended claims.

What is claimed is:

1. A switch comprising:

(A) first and second contacts;

(B) a toggle bar, said toggle bar being moveable between first and second positions;

(C) a spanner, said spanner having first and second positions that respectively correspond to said first and second positions of said toggle bar, said spanner establishing an electrical connection between said first and second contacts when said spanner is in one of said first and second positions and said spanner not establishing said electrical connection between said first and second contacts when said spanner is in the other of said first and second positions; and (D) a trip lever, said trip lever being capable of receiving an actuating force at an input location on said trip lever and transferring said actuating force to said toggle bar at an output location on said trip lever thereby causing said toggle bar to move from said first position to said second position of said toggle bar, said output location of said trip lever traveling a greater distance than said input location when said actuating force is transferred to said toggle bar.

2. A switch according to claim 1, wherein said switch further comprises (A) an over-travel plunger, said over-travel plunger being capable of receiving an actuating force and being moveable in response to said actuating force to transfer said actuating force to said trip lever;

(B) a pretravel plunger, said pretravel plunger being moveable in a longitudinal direction in response to an actuating force, said pretravel plunger including a post that is moveable with said pretravel plunger in said longitudinal direction; and (C) first and second levers, said first and second levers being hingedly mounted, said first and second levers being moveable in response to movement of said post to permit an aperture to form between said first and second levers that is sufficient in size to permit said post to pass between said first and second levers; and wherein said over-travel plunger is moveable along said longitudinal axis in response to movement of said first and second levers, said over-travel plunger having a cavity formed therein at a longitudinal end adjacent said post, said cavity being capable of receiving said post after said post passes between said first and second levers.

3. A switch according to claim 2, wherein said toggle bar has a third position;

wherein said switch further comprises first and second swing arms, said first and second swing arms being rotatably mounted so as to be moveable between first and second positions;

wherein, when said actuating force urges said toggle bar toward said third position of said toggle bar, said actuating force is transferred to said first and second swing arms and said first and second swing arms transfer said actuating force to said carrier, said transfer of said actuating force to said carrier being capable of breaking a weld between said first and second contacts and said spanner; and wherein said pretravel plunger, said first and second levers, said over-travel plunger, said toggle bar, and said first and second swing arms are rigid bodies, such that said switch is capable of transferring said actuating force to said first and second swing arms exclusively through a series of rigid body force transfers.

4. A switch according to claim 2, wherein said switch has an over-travel distance of at least 4.6 millimeters.

5. A switch according to claim 1, wherein said spanner is a first spanner, and wherein said switch further comprises third and fourth contacts and a second spanner, said second spanner having first and second positions that respectively correspond to said first and second positions of said toggle bar, said second spanner establishing an electrical connection between said third and fourth contacts when said second spanner is in one of said first and second positions and said second spanner not establishing said electrical connection between said third and fourth contacts when said second spanner is in the other of said first and second positions.

6. A switch according to claim 5, further comprising a carrier, said carrier having first and second positions that correspond to said first and second positions of said toggle bar, and said carrier having an overcenter position between said first and second positions, wherein said first spanner is mounted to said carrier by way of a first biasing spring and said second spanner is mounted to said carrier by way of a second biasing spring, said first and second biasing springs providing a biasing force to carry said carrier through said overcenter position when said carrier is moving from between said first and second positions.

7. A switch according to claim 4, wherein said first and second spanners are electrically isolated from each other.

8. A switch according to claim 1, wherein said switch has a trip point in a range of less than about 0.08 inches.

9. A switch according to claim 1, wherein said switch is a limit switch.

10. A switch comprising:

(A) a pretravel plunger, said pretravel plunger being moveable in a longitudinal direction in response to an actuating force, said pretravel plunger including a post that is moveable with said pretravel plunger in said longitudinal direction;

(B) first and second levers, said first and second levers being hingedly mounted, said first and second levers being moveable in response to movement of said post to permit an aperture to form between said first and second levers that is sufficient in size to permit said post to pass between said first and second levers;

(C) an over-travel plunger, said over-travel plunger being moveable along said longitudinal axis in response to movement of said first and second levers, said over-travel plunger having a cavity formed therein at a longitudinal end adjacent said post, said cavity being capable of receiving said post after said post passes between said first and second levers;

(D) first and second contacts; and (E) a spanner, said spanner being moveable between first and second positions in response to movement of said over-travel plunger, said spanner establishing an electrical connection between said first and second contacts when said spanner is in one of said first and second positions and said spanner not establishing said electrical connection between said first and second contacts when said spanner is in the other of said first and second positions.

11. A switch according to claim 10, wherein said toggle bar has a third position;

wherein said switch further comprises first and second swing arms, said first and second swing arms being rotatably mounted so as to be moveable between first and second positions;

wherein, when said actuating force urges said toggle bar toward said third position of said toggle bar, said actuating force is transferred to said first and second swing arms and said first and second swing arms transfer said actuating force to said carrier, said transfer of said actuating force to said carrier being capable of breaking a weld between said first and second contacts and said spanner; and wherein said pretravel plunger, said first and second levers, said over-travel plunger, said toggle bar, and said first and second swing arms are rigid bodies, such that said switch is capable of transferring said actuating force to said first and second swing arms exclusively through a series of rigid body force transfers.

12. A switch according to claim 10, wherein said spanner is a first spanner, and wherein said switch further comprises third and fourth contacts and a second spanner, said second spanner having first and second positions that respectively correspond to said first and second positions of said toggle bar, said second spanner establishing an electrical connection between said third and fourth contacts when said second spanner is in one of said first and second positions and said second spanner not establishing said electrical connection between said third and fourth contacts when said second spanner is in the other of said first and second positions.

13. A switch according to claim 12, further comprising a carrier, said carrier having first and second positions that correspond to said first and second positions of said toggle bar, and said carrier having an overcenter position between said first and second positions, wherein said first spanner is mounted to said carrier by way of a first biasing spring and said second spanner is mounted to said carrier by way of a second biasing spring, said first and second biasing springs providing a biasing force to carry said carrier through said overcenter position when said carrier is moving from between said first and second positions.

14. A switch according to claim 12, wherein said first and second spanners are electrically isolated from each other.

15. A switch according to claim 10, wherein said switch is a limit switch.

16. A switch comprising:

(A) first, second, third and fourth contacts;

(B) a toggle bar, said toggle bar being moveable and having a first position, a second position, and an overcenter position in between said first and second positions;

(C) a carrier, said carrier being slidably mounted on said toggle bar;

(D) a first spanner, said first spanner being mounted to said carrier, said first spanner having first and second positions that respectively correspond to said first and second positions of said toggle bar, said first spanner establishing an electrical connection between said first and second contacts when said first spanner is in one of said first and second positions and said spanner not establishing said electrical connection between said first and second contacts when said first spanner is in the other of said first and second positions;

(E) a second spanner, said second spanner being mounted to said carrier, said second spanner having first and second positions that respectively correspond to said first and second positions of said toggle bar, said second spanner establishing an electrical connection between said third and fourth contacts when said second spanner is in one of said first and second positions and said second spanner not establishing said electrical connection between said third and fourth contacts when said spanner is in the other of said first and second positions;

(F) first, second, third and fourth biasing springs, said first and second biasing springs being mounted between said first spanner and said carrier, said third and fourth biasing springs being mounted between said second spanner and said carrier, said first, second, third and fourth biasing springs providing a biasing force to carry said carrier through said overcenter position when said carrier is moving between said first and second positions.

17. A limit switch comprising:

(A) an operator head, said operator head including (1) a pretravel plunger, said pretravel plunger being moveable in a longitudinal direction in response to an actuating force, said pretravel plunger including a post that is moveable in said longitudinal direction, (2) first and second levers, said first and second levers being hingedly mounted within said operator head, said first and second levers being moveable in response to movement of said post to permit an aperture to form between said first and second levers that is sufficient in size to permit said post to pass between said first and second levers, and (3) an over-travel plunger, said over-travel plunger being moveable along said longitudinal axis in response to movement of said first and second levers, said over-travel plunger having a cavity formed therein at a longitudinal end adjacent said post, said cavity being capable of receiving said post after said post passes between said first and second levers;

(B) a switch base assembly, said switch base assembly including a switch block, said switch block further including (1) first and second contacts;

(2) a toggle bar, said toggle bar being moveable and having a first position, a second position, and a third position, (3) a spanner, said spanner having first and second positions that respectively correspond to said first and second positions of said toggle bar, said spanner establishing an electrical connection between said first and second contacts when said spanner is in one of said first and second positions and said spanner not establishing said electrical connection between said first and second contacts when said spanner is in the other of said first and second positions, (4) first and second swing arms, said first and second swing arms being rotatably mounted within said switch base assembly, said first and second swing arms being moveable between first and second positions, and wherein, when said actuating force urges said toggle bar toward said third position of said toggle bar, said actuating force is transferred to said first and second swing arms and said first and second swing arms transfer said actuating force to said carrier, said transfer of said actuating force to said carrier being capable of breaking a weld between said first and second contacts and said spanner; and (C) a terminal assembly, said terminal assembly including first and second operator terminals that are respectively coupled to said first and second contacts; and wherein said pretravel plunger, said first and second levers, said over-travel plunger, said toggle bar, and said first and second swing arms are rigid bodies, such that said limit switch is capable of transferring said actuating force to said toggle bar and said first and second swing arms exclusively through a series of rigid body force transfers.

18. A limit switch according to claim 17, further comprising a trip lever, said trip lever being operatively disposed between said over-travel plunger and said toggle bar, said trip lever being capable of receiving said actuating force from said travel plunger at an input location on said trip lever and transferring said actuating force to said toggle bar at an output location on said trip lever thereby causing said toggle bar to move from said first position to said second position of said toggle bar, said output location of said trip lever traveling a greater distance than said input location when said actuating force is transferred to said toggle bar.

19. A switch according to claim 17, wherein said spanner is a first spanner, and wherein said switch further comprises (A) a second spanner, said second spanner being electrically isolated from said first spanner, said second spanner having first and second positions that respectively correspond to said first and second positions of said toggle bar, said second spanner establishing an electrical connection between said first and second contacts when said second spanner is in one of said first and second positions and said second spanner not establishing said electrical connection between said first and second contacts when said second spanner is in the other of said first and second positions; and (B) a carrier, said carrier having first and second positions that correspond to said first and second positions of said toggle bar, and said carrier having an overcenter position between said first and second positions, wherein said first spanner is mounted to said carrier by way of a first biasing spring and said second spanner is mounted to said carrier by way of a second biasing spring, said first and second biasing springs providing a biasing force to carry said carrier through said overcenter position when said carrier is moving from between said first and second positions.

20. A limit switch comprising:

(A) an operator head, said operator head including (1) a pretravel plunger, said pretravel plunger being moveable in a longitudinal direction in response to an actuating force, said pretravel plunger including a post that is moveable with said pretravel plunger in said longitudinal direction, (2) first and second levers, said first and second levers being hingedly mounted within said operator head, said first and second levers being moveable in response to movement of said post to permit an aperture to form between said first and second levers that is sufficient in size to permit said post to pass between said first and second levers, and (3) an over-travel plunger, said over-travel plunger being moveable along said longitudinal axis in response to movement of said first and second levers, said over-travel plunger having a cavity formed therein at a longitudinal end adjacent said post, said cavity being capable of receiving said post after said post passes between said first and second levers;

(B) a switch base assembly, said switch base assembly including a switch block, said switch block further including (1) first and second contacts, (2) a toggle bar, said toggle bar being moveable and having a first position, a second position, and a third position, (3) a carrier, said carrier having first and second positions that correspond to said first and second positions of said toggle bar, said carrier having an overcenter position between said first and second positions, (4) a spanner, said spanner being mounted to said carrier, said spanner having first and second positions that respectively correspond to said first and second positions of said carrier, said spanner establishing an electrical connection between said first and second contacts when said spanner is in one of said first and second positions and said spanner not establishing said electrical connection between said first and second contacts when said spanner is in the other of said first and second positions, (5) first and second pivots, said first and second pivots having first, second, and overcenter positions that respectively correspond to said first, second, and overcenter positions of said carrier, and said first and second pivots being at least substantially perpendicularly oriented relative to a direction of toggle bar travel when said first and second pivots and said carrier are in said overcenter position, (6) a U-shaped spring, said U-shaped spring being mounted within said toggle bar, said U-shaped spring being coupled to said pivots such that said pivots are coupled between said carrier and said U-shaped spring, said U-shaped spring applying a force through said first and second pivots so as to cause said spanner to move between said first and second positions in snap action fashion, (7) a biasing spring, said biasing spring being coupled between said spanner and said carrier such that said spanner is coupled to said carrier by way of said biasing spring, said biasing spring providing a biasing force to carry said toggle bar through said overcenter position when said toggle bar is moving from said first position to said second position, (8) first and second swing arms, said first and second swing arms being rotatably mounted within said switch base assembly, said first and second swing arms being moveable between first and second positions, and wherein, when said actuating force urges said toggle bar toward said third position of said toggle bar, said actuating force is transferred to said first and second swing arms and said first and second swing arms transfer said actuating force to said carrier, said transfer of said actuating force to said carrier being capable of breaking a weld between said first and second contacts and said spanner; and (C) a trip lever, said trip lever being disposed at an interface between said operator head assembly and said switch base assembly, said trip lever receiving said actuating force from said over-travel plunger at an input location on said trip lever, and transferring said actuating force to said toggle bar at an output location on said trip lever, said output location of said trip lever traveling a greater distance than said input location when said actuating force is transferred to said toggle bar and causes said toggle bar to move from said first position to said second position of said toggle bar; and (D) a terminal assembly, said terminal assembly including first and second operator terminals that are respectively coupled to said first and second contacts; and wherein said pretravel plunger, said first and second levers, said over-travel plunger, said toggle bar, and said first and second swing arms are rigid bodies, such that said limit switch is capable of transferring said actuating force to said toggle bar and said first and second swing arms exclusively through a series of rigid body force transfers.

21. A limit switch according to claim 20, wherein said limit switch has an operating temperature in a range of about −18° C. to +110° C.

22. A limit switch according to claim 20, wherein said carrier is constructed of a plastic that has a relative temperature index of approximately 130° C.

23. A limit switch according to claim 20, wherein said over-travel plunger has an over-travel stroke of at least 4.6 millimeters.

24. A limit switch according to claim 20, wherein said first and second contacts have a diameter in a range of about 0.10 to 0.15 inches.

25. A limit switch according to claim 20, wherein said pretravel plunger and said over-travel plunger are constructed of metal.

* * * * *